US005460288A

United States Patent [19]

Balzeau

[11] Patent Number: 5,460,288

[45] Date of Patent: Oct. 24, 1995

[54] BOX EQUIPPED WITH A SLIDE-TYPE CLOSURE SYSTEM

[75] Inventor: Pascal Balzeau, Bazoches-les-Gallerandes, France

[73] Assignee: L'OREAL, Paris, France

[21] Appl. No.: 70,970

[22] Filed: Jun. 4, 1993

[30] Foreign Application Priority Data

Jun. 5, 1992 [FR] France ..... 92 06857

[51] Int. Cl.[6] ..... B65D 45/16; A45D 33/00

[52] U.S. Cl. ..... 220/326; 132/293

[58] Field of Search ..... 220/324, 326; 132/293

[56] References Cited

U.S. PATENT DOCUMENTS 5,135,126 8/1992 Petit ..... 220/326

FOREIGN PATENT DOCUMENTS 0467761 1/1992 European Pat. Off. .
2512650 3/1983 France .
8605194 5/1986 Germany .

*Primary Examiner*—Allan N. Shoap
*Assistant Examiner*—Vanessa Caretto
*Attorney, Agent, or Firm*—Staas & Halsey

[57] ABSTRACT

Box fitted with a closure device including a T-shape slide that slips inside a bottom of the box and is movable between box opening and box closing positions. A crossbar of the T is an activation mechanism to open the box. A main shank of the T has elastic claws curved towards one another to abut a surface of the bottom of the box and restore the box closing position of the slide.

21 Claims, 1 Drawing Sheet

BOX EQUIPPED WITH A SLIDE-TYPE CLOSURE SYSTEM

BACKGROUND OF THE INVENTION

This invention concerns a box having two parts articulated along a hinge, one part constituting the lid and the other the bottom of the box, and used mainly to contain cosmetic products.

Boxes of this type that close by a closure system including two elements fitted respectively to the edge of the lid and the edge of the bottom opposite the hinge are known. In most cases the closure system includes a catch attached to the edge of the lid, which engages in a slot fixed to the bottom of the box, though the converse is also possible. It is known for the opening mechanism of the closure system to be fitted in a slide that can slip between guides or in a channel, in the bottom of the box, after manual operation of an activation mechanism carried by the slide and accessible from the outside, such that an elastic restoring mechanism cooperates with the slide and a contact surface in the bottom of the box to enable the slide to return to its rest position, and a catch mechanism engages with detents attached to the bottom of the box to retain the slide in relation to the bottom of the box.

It is also known for the bottom of the box to include a single hollow piece with an internal space or two pieces: a platen and a base which between them, form the internal space.

In EP-A 0 467 761 a box is described including a slide with the general shape of a U in which the elastic restoring mechanism includes two branches, each formed by an extension of one arm of the U-shaped body, and the catch mechanism includes lateral catches projecting sideways from the arms of the U-shaped body at the base of those branches and engaging with detents fixed to the edges of the box. In this arrangement the slide's guide channel is short and wide. Since the slide is a plastic molding, the shape of the channel does not always allow the play resulting from the molding operation to be taken up.

Consequently, operation is not convenient for the user because the slide can jam or grate during its sliding movement. Moreover, the elastic devices fitted to the arms of the U-shaped slide do not allow sufficient movement of the slide and it can sometimes be difficult to open the box.

SUMMARY OF THE INVENTION

The present invention aims to improve upon these disadvantages by using, in the closure system, a slide of such a shape that it can slip in a relatively long and narrow channel. This makes for better guiding of the slide and enables any play due to its molding to be taken up. By using as the elastic restoring device two "semicircular" claws curved towards one another, whose bending allows the slide to move further, it is easier to open the box.

Thus, the subject of the present invention is a box formed of two parts articulated along a hinge, one part constituting the lid and the other part the bottom of the box, and including a closure system with elements fitted, some to the lid, and some to the bottom of the box. The element in the bottom of the box is a slide that can slip in a channel located at the bottom of the box. The slide is activated from outside the box, and elastic restoring devices come into contact with a surface attached to the bottom of the box, and a catch device engages with detents attached to the bottom of the box. The slide has the general shape of a T, whose crossbar constitutes the activation mechanism accessible from the outside while the end of the main shank of the T extends inside the channel. Its end opposite the activation mechanism has two elastic claws curved towards one another symmetrically with respect to the longitudinal axis of the T-shaped slide.

The catch mechanism preferably includes two projections carried by elastic tongues, perpendicular to the central plane of the T-shaped slide, situated at each end of the crossbar of the T. The projections engage with detents situated on partitions on the bottom of the box perpendicular to the central plane of the bottom.

The elastic claws are of a shape such that when the user presses the crossbar of the T-shaped slide, their radius of curvature decreases by bending and their ends move along the contact surface attached to the bottom of the box perpendicular to the central plane of the latter. Preferably, these claws should be wider nearer the end of the main shank of the T than near their other end, so that the bending of the claws essentially takes place near their ends. It is advantageous if their cross-section decreases progressively.

Preferably, the elastic claws have at their ends a reinforcement piece circular in cross-section, of cylindrical shape, which facilitates the movement of the ends of the claws along the contact surface as they are bending: in effect, the contact of the claws against the contact surface is the generatrix of a cylinder and the movement of the claws over the contact surface is not subject to much friction.

The sides of the main shank of the T are, preferably, fitted with guide elements, preferably wedges which, besides, facilitate the movement of the slide in its channel.

These guide elements may be formed with a cavity enabling them to be somewhat elastic, so as to take up any play of the slide during their movement.

In accordance with a preferred form, the lid has a catch and a rectangular opening at its edge, turned towards the main shank and a projection forming a pawl is fitted to the crossbar of the slide.

BRIEF DESCRIPTION OF THE DRAWINGS

To explain the subject of the present invention more clearly a version of such a box will be described in an illustrative and non-limiting way, with reference to the attached drawings.

In the drawings.

DESCRIPTION OF THE PREFERRED EMBODIMENTS

Figure 1:
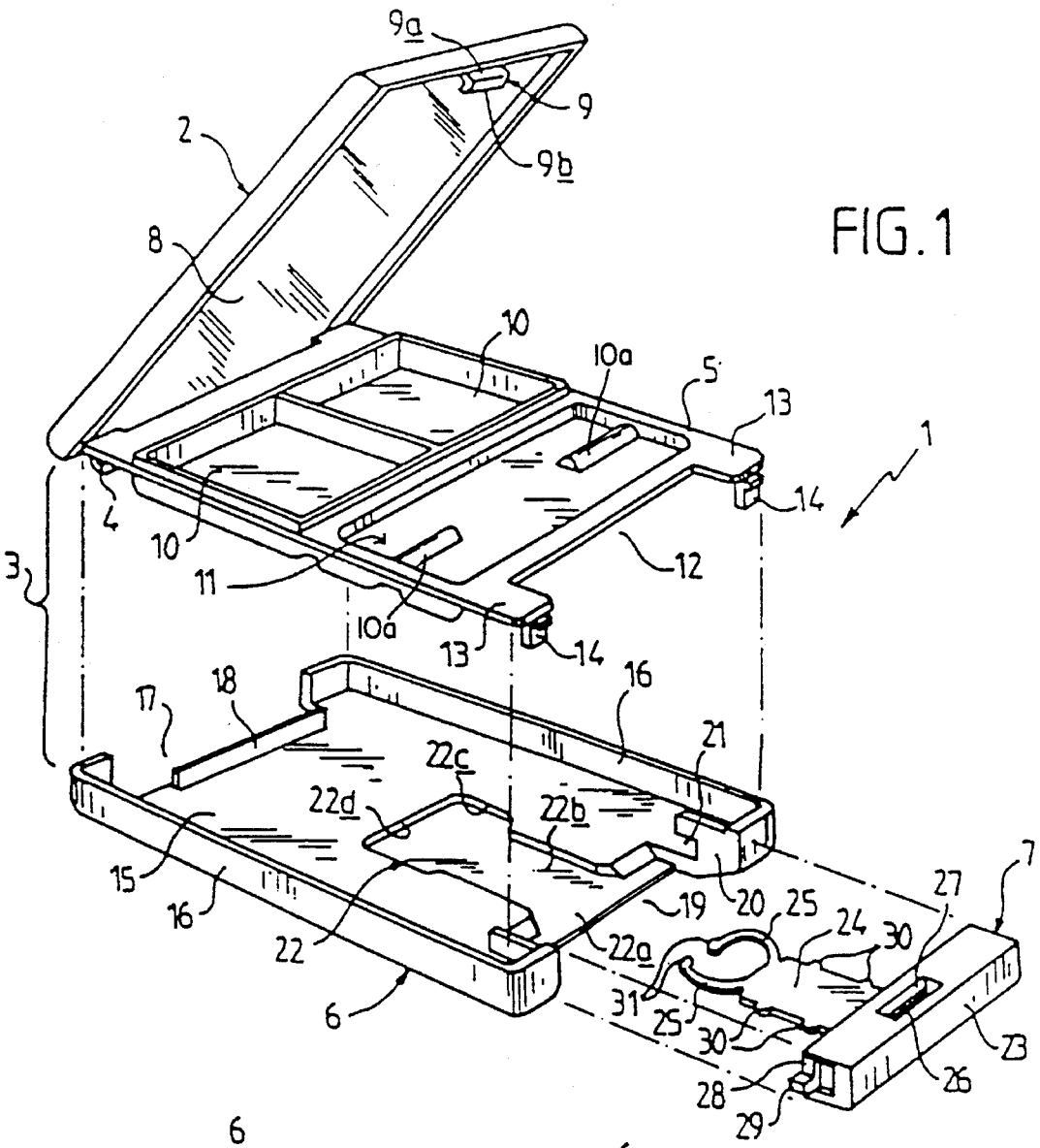
FIG. 1 is an expanded view in perspective of a box conforming to the invention.
Figure 2:
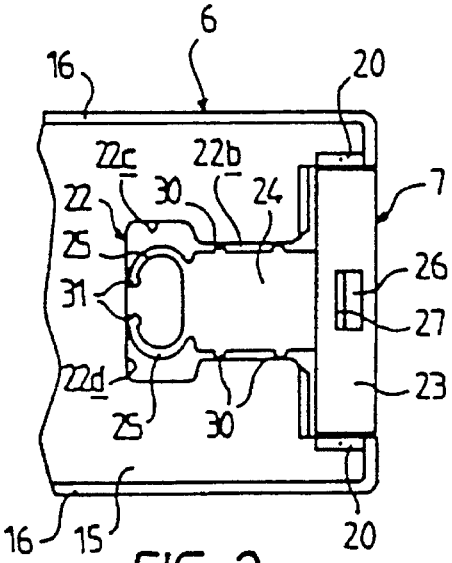
FIG. 2 is a detailed view of the slide after assembly in the closed position.
Figure 3:
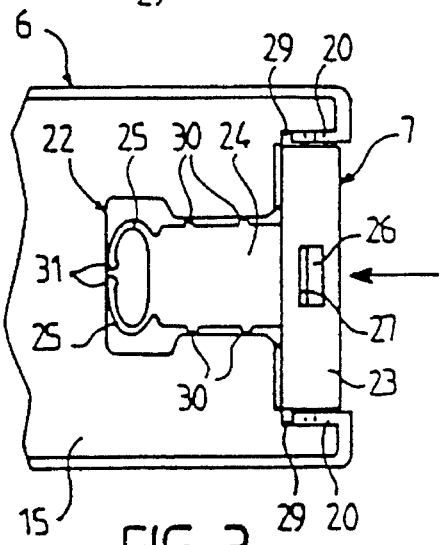
FIG. 3 is a detailed view of the same slide in the open position.

The cosmetics box conforming to the invention, illustrated in FIG. 1, is designated as a whole by reference 1. It includes a lid 2 hinged to a bottom 3 of the box along a hinge 4. In the version shown, the bottom 3 of the box includes a platen 5 and a base 6 that fit together and are joined, for example by clipping. A slide 7 slips in a space between the platen 5 and the base 6 after assembly by insertion. A mirror 8 is fitted to the inside of the lid 2. At the center of an edge of the lid 2 on the side opposite a hinge 4, is a catch 9 including two rectangular plates 9*a*, 9*b* making a right-angle; the plate 9*a* attached to the edge of the lid 2 is perpendicular to the central plane of the lid and the plate 9*b* is parallel to that central plane and projects inwards towards the inside of the lid.

The platen 5 is hollowed out to form various compartments 10. These compartments 10 are intended to hold blocks of cosmetic products and the shallowest 11 of them, partially divided in two by a central rib 10*a*, is designed to hold two small brushes or other applicators. The side of the platen 5 opposite the hinge 4 is recessed at 12 to enable insertion of the slide 7. At the ends of wings 13 forming the limits of the recess 12 on either side of the edge of the platen 5, there are two plates 14 perpendicular to the central plane of the platen 5 and having a projection extending outwards, that can engage with the elements (not shown) of the base when the platen 5 is fitted onto the base 6.

The base 6 includes a rectangular flat surface 15 with side walls 16 perpendicular to the flat surface 15. On the side of the hinge 4 there is a recess 17 in the side wall into which the hinge 4 of the platen 5 fits. At the level of this recess 17, on the flat surface 15 of the base 6, a perpendicular partition 18 offset towards the inside of the box is located to enclose the hinge 4.

On the side of the base 6 opposite the hinge 4, the side wall 16 also has a frontal recess 19 each of whose edges has a perpendicular return-flange 20 with a slot 21 in it.

The recess 19 is also bounded by the flat surface 15 of the base 6. In the surface 15 there is a hollow imprint 22 including in succession a rectangular wide area 22*a* one edge of which is the edge of the recess 19, a part 22*b* forming a channel that guides the movement of the slide 7, and another wide area 22*c* ending in a contact surface 22*d*. It may suffice to form this imprint only in the base 6, but it is preferable if a corresponding imprint is formed in the face of the platen 5 opposite to the compartments 10, so that the two imprints together contribute to forming the slipping channel for the slide 7.

The slide 7 has the general shape of a T with a crossbar 23 and a perpendicular main shank 24 fitted at its free end with two curved claws 25. The crossbar 23 is hollow, but has reinforcing webs (not shown) to ensure its rigidity. At the top of the crossbar 23 a rectangular opening 26 is formed, which has a pawl 27 along its edge on the side nearest the main shank 24. On the lateral ends of the crossbar 23 there are two flexible tongues 28 whose ends nearest to the base 6 are free. Close to those free ends, there are projections 29 facing outwards and so positioned that during assembly they will fit into the slots 21 of the return-flanges 20. The main shank 24 of the slide 7 includes a rectangular plate thinner than the crossbar 23, along whose longitudinal edges there are wedges 30 to guide the shank along the channel 22*b*, namely four of these in the version represented. The two claws 25, curved towards one another, are identical and are located symmetrically with respect to the longitudinal axis of the T. These claws are of constant thickness. At their ends they have reinforcement pieces 31 of circular cross-section shaped like cylinders, and these reinforcement pieces 31 are the same thickness as the claws 25. The claws 25 are wider at the point where they join the main shank 24 of the slide than at the level of their junction with the reinforcement pieces 31. To facilitate molding, the crossbar 23 is molded as an open piece at the bottom and then covered with a cover-plate, notably of metal, whose transverse shape is a U. One of the arms of the U has a rectangular opening corresponding to the opening 26.

When the box has been assembled and before it is opened, the crossbar 23 of the slide 7 fits into the recess 19 of the base 6 with part of its lower face resting on the wide part 22*a* of the imprint, while leaving an area of this part 22*a* clear to allow the slide 7 to slip. Most of the main shank 24 is inside the channel 22*b*, with its wedges 30 in contact with the edges of the imprint 22 bordering the channel 22*b*. The curved claws 25 are in the wider portion 22*c* and the reinforcement pieces 31 at their ends are in contact with the contact surface 22*d*. The projections 29 on the flexible tongues 28 fit into the bottom of the slots 21 formed in the return-flanges 20 so as to prevent the slide from opening under the action of the claws 25.

When the user wishes to open the box 1, he presses the crossbar 23 of the slide 7 parallel to the central plane of the box and towards the hinge. The slide 7 slips inside the imprint 22 and the claws 25 curve, such that the pieces 31 at their ends move towards one another over the contact surface 22*d*. Thanks to the shape of the ends of the claws 25, their contact with the contact surface is virtually punctiform, which facilitates the sliding of the claws 25 over the contact surface 22*d*. Moreover, thanks to their variable width, the claws curve progressively from their ends and there is no risk of buckling at the level of their joint with the main shank 24. This progressiveness ensures that the operation is gentle, which makes opening the box easier. The slide 7 moves towards the inside of the bottom 3 of the box 1, the catch 9 on the lid 2 disengages from the pawl 27, and the box 1 opens. The slide 7 moves back to its opening position when the pressure on the crossbar 23 has stopped. When the user re-closes the box 1, the catch 9 enters the opening 26 until it engages with the pawl 27.

Thanks to the fact that the slide 7 is guided within the channel 22*b* over a sufficient length, the fact that the claws 25 are at the end of the main shank of the T-shaped slide 7, and the fact that the claws 25 make virtually a point contact with the contact surface 22*d*, the user has an agreeable impression of great flexibility when using the closure device.

I claim:

1. A box, comprising:

two parts articulated along a hinge, one of these parts being a lid and the other a bottom of the box; and a closure system having elements forming part of the lid and the bottom of the box, the element in the bottom of the box being a slide that can slip inside a channel at the bottom of the box, this slide including an activation mechanism accessible from outside the box, an elastic restoring device on the slide that makes contact with a surface on the bottom of the box, and a catch that engages with the bottom of the box, wherein the slide has the general shape of a T, a crossbar of which forms the activation mechanism accessible from outside and a main shank which extends inside the channel, and wherein said elastic restoring device is located at an end of the main shank opposite the activation mechanism and comprises two elastic claws curved towards one another symmetrically with respect to the longitudinal axis of the T-shaped slide.

2. A box according to claim 1, wherein the catch includes two projections attached to elastic tongues, perpendicular to a central plane of the slide.

3. A box according to claim 2, wherein the projections engage in slots located in partitions of the bottom of the box, perpendicular to a central plane of the bottom of the box.

4. A box as recited in claim 3, wherein the elastic claws are wider near the main shank of the T, than near the ends of the claws.

5. A box as recited in claim 3, wherein the elastic claws have at ends thereof reinforcement pieces of circular cross-section.

6. A box as recited in claim 3, wherein sides of the main shank of the T have guiding wedges.

7. A box as recited in claim 3, wherein the bottom of the box includes a platen and a base that fit together.

8. A box as recited in claim 2, wherein the elastic claws are wider near the main shank of the T, than near the ends of the claws.

9. A box as recited in claim 2, wherein the elastic claws have at ends thereof reinforcement pieces of circular cross-section.

10. A box as recited in claim 2, wherein sides of the main shank of the T have guiding wedges.

11. A box as recited in claim 2, wherein the bottom of the box includes a platen and a base that fit together.

12. A box according to claim 1, wherein the elastic claws are wider near the main shank of the T, than near ends of the claws.

13. A box as recited in claim 12, wherein the elastic claws have at their ends reinforcement pieces of circular cross-section.

14. A box as recited in claim 12, wherein sides of the main shank of the T have guiding wedges.

15. A box as recited in claim 12, wherein the bottom of the box includes a platen and a base that fit together.

16. A box according to claim 1, wherein the elastic claws have at ends thereof reinforcement pieces of circular cross-section.

17. A box as recited in claim 16, wherein sides of the main shank of the T have guiding wedges.

18. A box as recited in claim 16, wherein the bottom of the box includes a platen and a base that fit together.

19. A box according to claim 1, wherein sides of the main shank of the T have guiding wedges.

20. A box as recited in claim 19, wherein the bottom of the box includes a platen and a base that fit together.

21. A box according to claim 1, wherein the bottom of the box includes a platen and a base that fit together.

* * * * *